US009067211B2

(12) United States Patent
Subbannavar et al.

(10) Patent No.: US 9,067,211 B2
(45) Date of Patent: Jun. 30, 2015

(54) ABRASIVE ROLL ASSEMBLY

(75) Inventors: Chaithanya B. Subbannavar, Bangalore (IN); Naveen H. C. Kumar, Bangalore (IN)

(73) Assignee: Buhler (India) Pvt. Ltd., Bangalore (IN)

( * ) Notice: Subject to any disclaimer, the term of this patent is extended or adjusted under 35 U.S.C. 154(b) by 199 days.

(21) Appl. No.: 13/817,396

(22) PCT Filed: Oct. 27, 2010

(86) PCT No.: PCT/IN2010/000699

§ 371 (c)(1), (2), (4) Date: Mar. 29, 2013

(87) PCT Pub. No.: WO2012/056461

PCT Pub. Date: May 3, 2012

(65) Prior Publication Data

US 2013/0206887 A1 Aug. 15, 2013

(51) Int. Cl.

| | |
|---|---|
| ***B02C 4/30*** | (2006.01) |
| ***B02B 3/04*** | (2006.01) |
| ***B02C 4/28*** | (2006.01) |

(52) U.S. Cl.

CPC ... *B02C 4/30* (2013.01); *B02B 3/04* (2013.01); *B02C 4/286* (2013.01)

(58) Field of Classification Search

CPC ..... B02C 4/30; B02C 4/286

USPC ..... 99/618, 519, 620, 621, 623; 241/89.3, 241/257.1

See application file for complete search history.

(56) References Cited

U.S. PATENT DOCUMENTS

| | | | | |
|---|---|---|---|---|
| 4,815,370 | A | 3/1989 | Collins | 99/618 |
| 5,142,784 | A | 9/1992 | Lee et al. | 29/895.21 |
| 6,193,179 | B1 | 2/2001 | Behrmann et al. | 241/89.3 |

FOREIGN PATENT DOCUMENTS

| | | | | |
|---|---|---|---|---|
| JP | 10202122 | 1/1997 | | B02B 3/04 |
| WO | WO 2006/012756 A1 | 2/2006 | | B02B 3/04 |

OTHER PUBLICATIONS

International Search Report and Written Opinion for PCT/IN2010/000699, dated Aug. 29, 2011.

*Primary Examiner* — Mark Rosenbaum

(74) *Attorney, Agent, or Firm* — Brinks Gilson & Lione

(57) ABSTRACT

The present invention relates to an abrasive roll assembly, a conveyor assembly and a milling machine having the same. The abrasive roll assembly comprises an abrasive roll element configured for milling food grains.

20 Claims, 5 Drawing Sheets

ABRASIVE ROLL ASSEMBLY

CROSS REFERENCE TO RELATED APPLICATIONS

This application claims the benefit under 35 U.S.C. §371 of International Application No. PCT/IN2010/000699, filed on Oct. 27, 2010, International Publication No. WO 2012/056461 A1, which is incorporated by reference herein.

FIELD OF THE INVENTION

The present invention relates to milling machines, specifically vertical abrasive type milling machines for food grains. The present invention particularly relates to an abrasive roll assembly for the vertical abrasive type milling machine.

BACKGROUND OF THE INVENTION

Abrasive roll assemblies are commonly used in a milling machine such as vertical abrasive type milling machine, having a milling chamber for polishing or whitening food grains, in particular rice grains. In the vertical abrasive type milling machine, the food grains to be milled are freely supplied from a food grain feeding system to the vicinity of the screw conveyor, through which the food grains are supplied to the milling chamber. The food grains are milled in the milling chamber formed by abrasive roll assemblies and perforated arcute sheet cover assemblies. The abrasive roll assemblies are assembled with abrasive stones for milling or whitening food grains received from the screw conveyor. The abrasive roll assemblies are configured as food grain polisher for the milling machine and are driven by a main shaft to polish the food grains.

In the milling machine, each abrasive roll assembly are mounted on a vertical main shaft extending vertically one over the other, and are rotated with the help of main shaft during milling. The food grains hits the abrasive stones of the abrasive roll assemblies in the milling chamber and milling action takes place inside the milling chamber. The milled food grains collected at bottom of milling chamber discharged through discharge disk. One of the conventional vertical milling machines is provided with milling parts and the main shaft, which discloses that the main shaft is present through out the milling machine and is being connected to all the abrasive roll assemblies for its rotation to maintain integrity of the milling machine.

Normally, the last or bottom most abrasive roll assembly can easily and rapidly wears in comparison with other abrasive roll assemblies in the milling machine during use. The worn-out last abrasive roll assembly affects overall performance and efficiency of the milling machine, and therefore it has to be replaced after the specific time. Since the existing milling machines consist of the vertical main shaft on which all the abrasive roll assemblies are placed one over the other, the entire vertical shaft along with abrasive roll assemblies should be taken off during maintenance work, even for replacing the last abrasive roll assembly.

With respect to all the conventional milling machines, it is necessary to disassemble each abrasive roll assemblies of the milling machine in order to access and replace the worn-out abrasive roll assembly, since all the roll assemblies are directly coupled to the vertical main shaft throughout for its rotation. Further, the disassembling of milling machine is very time and labor consuming and too tedious, as the construction of rotor main shaft is complicated and the replacement of bottom worn-out abrasive roll requires dismantling of rotor shaft assembly and various other parts of the milling machine, which increases repair and maintenance time and disturbs pulley and axial alignment of the milling machine. For higher capacity milling machines, the volume of milling chamber is changed by increasing the diameter of the abrasive roll assemblies and screen assembly, thus increasing the weight of each components of the milling machine. Hence, it increases the difficulty of assembly and disassembly of each component, and also increases installation time and maintenance cost of the milling machine.

Therefore, it is desirable to provide an improved and unique abrasive roll assembly for a milling machine, which is capable of overcoming the aforementioned drawbacks. The present arrangement of abrasive roll assembly aids easy removal and replacing of the worn-out roll assembly without dismantling all components of the milling machine and without altering pulley and axial alignment.

SUMMARY OF THE INVENTION

An object of the present invention is to provide an abrasive roll assembly, which facilitates easy removal and replacing of the worn-out roll assembly without dismantling all components of the milling machine and without altering pulley and axial alignment.

Another object of the present invention is to provide an abrasive roll assembly, which is simple in construction and facilitates easy maintenance and handling by single untrained person.

Yet another object of the present invention is to provide a milling machine having an abrasive roll assembly, which minimizes labor, time and cost consumption during maintenance and replacement of worn-out roll assembly.

According to one aspect, the present invention, which achieves the objectives, relates to an abrasive roll assembly comprising an abrasive roll element configured for milling food grains. An abrasive roll flange is composed of a projecting member formed on its outer periphery, a set of through holes configured for mounting the abrasive roll flange to an adjacent flange by means of fasteners, a set of projecting lugs formed on its upper portion, with guiding and resting portions, a set of projecting pads arranged with threaded holes for mounting the adjacent flange, and a set of guiding members circumferentially spaced apart each other to form a set of openings for entry and exit of the adjacent flange. A supporting plate is placed in opposite to the projecting member of the abrasive roll flange, such that the supporting plate is fastened to the abrasive roll flange using fasteners to secure and hold the abrasive roll element. After inserting the abrasive roll assembly from bottom through openings of the adjacent flange, the abrasive roll assembly is rotated to make the resting portion of each projecting lug of the abrasive roll flange resting on the surface of each guiding member of the adjacent flange, such that each through hole of the abrasive roll flange is aligned with threaded hole in each projecting pad of the adjacent flange for mounting the abrasive roll assembly to the adjacent flange, which ensures centre axial alignment of both the abrasive roll assembly and the adjacent flange with respect to a main shaft of a milling machine. Such arrangement of abrasive roll assembly facilitates easy removal and replacing of the worn-out roll assembly without dismantling all components of the milling machine and without altering pulley and axial alignment.

While fixing the abrasive roll assembly to the adjacent flange, the guiding portion of each projecting lug of the abrasive roll assembly is axially guided and aligned on guiding surface of each guiding member of the adjacent flange, such that centre axial alignment in both the abrasive roll assembly and the adjacent flange is maintained with respect to the main shaft of the milling machine. The guiding portion of each projecting lug and the guiding surface of each guiding member are formed of a combination of circular surface and conical surface. The adjacent flange represents either a conveyor flange or an abrasive roll flange. The abrasive roll flange is configured with a central air opening for free air circulation inside a milling chamber from top and bottom side of the milling machine. The through holes, the projecting lugs and the projecting pads are circumferentially spaced apart each other.

According to another aspect, the present invention, which achieves the objectives, relates to a conveyor assembly comprising an abrasive roll element configured for milling food grains. A conveyor flange is assembled with a screw conveyor and is coupled to a main shaft of a milling machine by means of locking nut. The conveyor flange is composed of a projecting member formed on its outer periphery, a set of projecting pads arranged with threaded holes for mounting an adjacent abrasive roll flange, and a set of guiding members circumferentially spaced apart each other to form a set of openings for entry and exit of the adjacent abrasive roll flange. A supporting plate is placed in opposite to the projecting member of the conveyor flange, such that the supporting plate is fastened to the conveyor flange using fasteners to secure and hold the abrasive roll element. After inserting the adjacent abrasive roll flange from bottom through the openings of the conveyor flange, the adjacent abrasive roll flange is rotated to make each projecting lug of the adjacent abrasive roll flange resting on the surface of each guiding member of the conveyor flange, such that the threaded hole in each projecting pad of the conveyor flange is aligned with each through hole of the adjacent abrasive roll flange for mounting the adjacent abrasive roll flange to the conveyor flange, which ensures centre axial alignment of both the conveyor flange and the adjacent abrasive roll flange with respect to the main shaft of the milling machine.

While fixing the adjacent abrasive roll flange to the conveyor assembly, a guiding portion of each projecting lug of the adjacent abrasive roll flange is axially guided and aligned on guiding surface of each guiding member of the conveyor assembly, such that centre axial alignment in both the conveyor assembly and the adjacent abrasive roll flange is maintained with respect to the main shaft of the milling machine. The conveyor flange is configured with a set of air openings for free air circulation inside a milling chamber from top and bottom side of the milling machine. The projecting pads are circumferentially spaced apart each other. The guiding members are placed in proximity to the projecting pads. The guiding surface of each guiding member is formed of a combination of circular surface and conical surface.

According to further aspect, the present invention, which achieves the objectives, relates to a vertical abrasive type milling machine comprising a bearing housing vertically mounted on a main structure of the milling machine. A main shaft is rotatably supported in the bearing housing by means of upper and lower bearings, the main shaft is mounted to a machine pulley that is connected to a motor pulley by means of conveying belts. At lease one conveyor assembly, comprising: an abrasive roll element configured for milling food grains. A conveyor flange is assembled with a screw conveyor and coupled to the main shaft by means of locking nut. The conveyor flange is composed of a projecting member formed on its outer periphery, a set of projecting pads arranged with threaded holes for mounting an adjacent abrasive roll flange, and a set of guiding members circumferentially spaced apart each other to form a set of openings for entry and exit of the adjacent abrasive roll flange. A supporting plate is placed in opposite to the projecting member of the conveyor flange, such that the supporting plate is fastened to the conveyor flange using fasteners to secure and hold the abrasive roll element. After inserting the adjacent abrasive roll flange from bottom through the openings of the conveyor flange, the adjacent abrasive roll flange is rotated to make each projecting lug of the adjacent abrasive roll flange resting on the surface of each guiding member of the conveyor flange, such that the threaded hole in each projecting pad of the conveyor flange is aligned with each through hole of the adjacent abrasive roll flange for mounting the adjacent abrasive roll flange to the conveyor flange, which ensures centre axial alignment of both the conveyor flange and the adjacent abrasive roll flange with respect to the main shaft of the milling machine. One or more abrasive roll assemblies, each comprising: an abrasive roll element configured for milling food grains. An abrasive roll flange is composed of a projecting member formed on its outer periphery, a set of through holes configured for mounting the abrasive roll flange to an adjacent flange by means of fasteners, a set of projecting lugs formed on its upper portion, with guiding and resting portions, a set of projecting pads arranged with threaded holes for mounting the adjacent flange, and a set of guiding members circumferentially spaced apart each other to form a set of openings for entry and exit of the adjacent flange. A supporting plate is placed in opposite to the projecting member of the abrasive roll flange, such that the supporting plate is fastened to the abrasive roll flange using fasteners to secure and hold the abrasive roll element. After inserting the abrasive roll assembly from bottom through openings of the adjacent flange, the abrasive roll assembly is rotated to make the resting portion of each projecting lug of the abrasive roll flange resting on the surface of each guiding member of the adjacent flange, such that each through hole of the abrasive roll flange is aligned with threaded hole in each projecting pad of the adjacent flange for mounting the abrasive roll assembly to the adjacent flange, which ensures centre axial alignment of both the abrasive roll assembly and the adjacent flange with respect to the main shaft of the milling machine.

The rotary movement of the main shaft is transferred to the conveyor assembly for driving and rotating one or more abrasive roll assemblies attached to it, which evenly distributes rotary motion from top to bottom of the milling machine and ensures co-linearity of axial centre of the conveyor assembly and the one or more abrasive roll assemblies in relation to the main shaft. The arrangement of conveyor assembly and abrasive roll assemblies in this milling machine minimizes labor, time and cost consumption during maintenance and replacement of worn-out roll assembly.

BRIEF DESCRIPTION OF THE DRAWINGS

The invention will be discussed in greater detail with reference to the accompanying Figures.

DETAILED DESCRIPTION OF THE INVENTION

The present invention will be described herein below with reference to the accompanying drawings.

Figure 1:
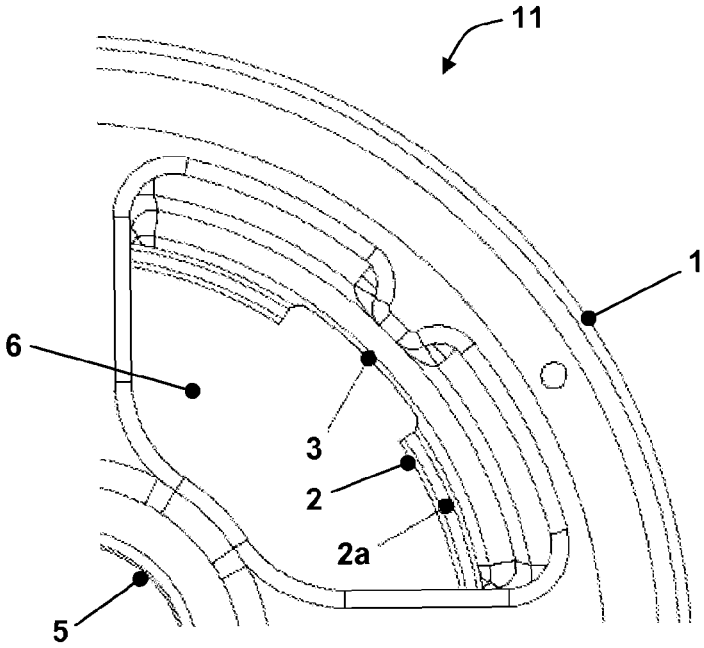
FIG. 1 illustrates a partial view of a screw conveyor flange, in accordance with an exemplary embodiment of the present invention.
Figure 2:
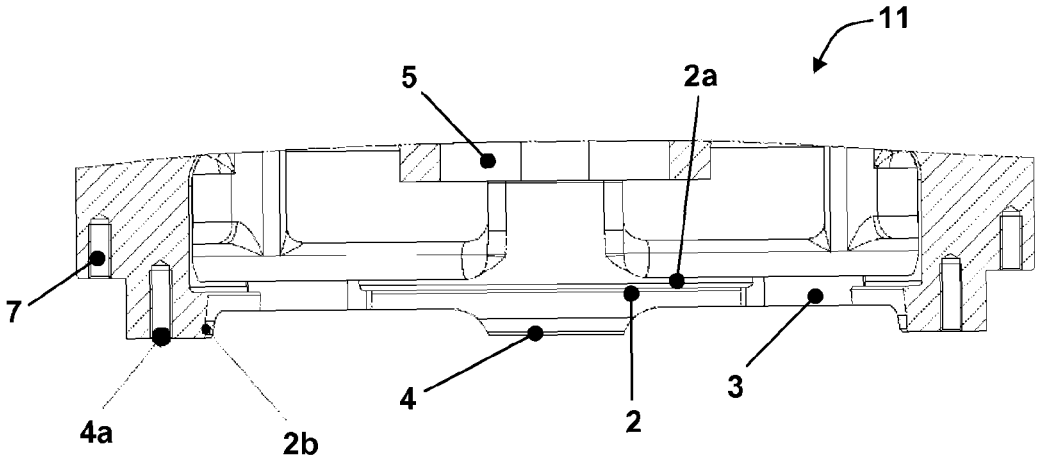
FIG. 2 illustrates a sectional front view of the screw conveyor flange, in accordance with an exemplary embodiment of the present invention.

Referring to FIG. 1, a partial view of a screw conveyor flange 11 is illustrated, in accordance with an exemplary embodiment of the present invention. A conveyor assembly 10 comprises an abrasive roll element 40 configured for milling food grains, a screw conveyor flange 11 and a supporting plate 30. The conveyor flange 11 is assembled with a screw conveyor (not shown) and is coupled to a main shaft 101 of a milling machine 100 by means of locking nut 102. The conveyor flange 11 has a central opening 5 for receiving the main shaft 101 of the milling machine 100, as shown in FIG. 2, which illustrates a sectional front view of the screw conveyor flange 11, in accordance with an exemplary embodiment of the present invention. The screw conveyor flange 11 consists of a projecting member 1, a set of circumferentially spaced projecting pads 4, a set of circumferentially spaced internal guiding members or lands 2 for resting subsequent abrasive roll assemblies 20, and a set of circumferentially spaced openings/cut-outs 3 for entry and exit of abrasive roll flange 21. The conveyor flange 11 also consists of internal threads 7 for mounting top abrasive roll element 40 using fasteners 50 such as bolts, and a set of air openings 6 for air entry or circulation into the milling chamber area 103 from top to bottom of the milling machine 100.

The projecting member 1 is formed on the outer periphery of the conveyor flange 11. The projecting pads 4 are arranged with circumferentially spaced threaded holes 4*a* for mounting subsequent or adjacent abrasive roll assemblies 20. The guiding members 2 are circumferentially spaced apart each other to form a set of openings 3 for entry and exit of the adjacent abrasive roll flange 21. The guiding members 2 are placed in proximity to the projecting pads 4. Each guiding member 2 exhibits internal guiding surface 2*b* to guide and align external guiding portion 23*b* of each abrasive roll projecting lug 23, where the guiding surface 2*b* of the guiding member 2 is formed of a combination of circular surface and conical surface. The supporting plate 30 is placed in opposite to the projecting member 1 of the conveyor flange 11, such that the supporting plate 30 is fastened to the conveyor flange 11 using fasteners 50 to secure and hold the abrasive roll element 40.

After inserting the adjacent abrasive roll flange 21 from bottom through the openings 3 of the conveyor flange 11, the adjacent abrasive roll flange 21 is rotated to make each projecting lug 23 of the adjacent abrasive roll flange 21 resting on the surface 2*a* of each guiding member 2 of the conveyor flange 11, such that the threaded hole 4*a* in each projecting pad 4 of the conveyor flange 11 is aligned with each through hole 27 of the subsequent abrasive roll flange 21 for mounting the subsequent abrasive roll flange 21 to the conveyor flange 11, which ensures centre axial alignment of both the conveyor flange 11 and the subsequent abrasive roll flange 21 with respect to the main shaft 101 of the milling machine 100. While fixing the subsequent abrasive roll flange 21 to the conveyor assembly 10, a guiding portion 23*b* of each projecting lug 23 of the subsequent abrasive roll flange 21 is axially guided and aligned on the guiding surface 2*b* of each guiding member 2 of the conveyor assembly 10, such that centre axial alignment in both the conveyor assembly 10 and the subsequent abrasive roll flange 21 is maintained with respect to the main shaft 101 of the milling machine 100.

Figure 3:
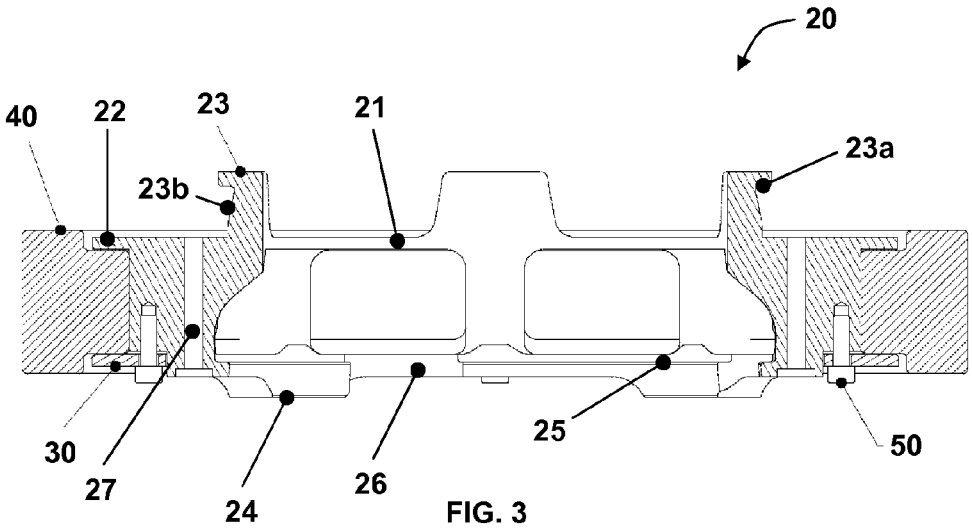
FIG. 3 illustrates a sectional front view of an abrasive roll assembly, in accordance with an exemplary embodiment of the present invention.

Referring to FIG. 3, a sectional front view of an abrasive roll assembly 20 is illustrated, in accordance with an exemplary embodiment of the present invention. The abrasive roll assembly 20 comprises an abrasive roll element 40 for milling food grains, an abrasive roll flange 21 and a supporting plate 30. The abrasive roll flange 21 is arranged with a projecting member 22, a set of circumferentially spaced clearance or through holes 27 for mounting abrasive roll assemblies 20, a set of circumferentially spaced projecting lugs 23 for supporting the abrasive roll assembly 20, a set of circumferentially spaced projecting pads 24, a set of circumferentially spaced guiding members or lands 25 for resting subsequent abrasive roll flanges or assemblies 20, and a circumferentially spaced openings/cut-outs 26 for entry and exit of subsequent abrasive roll assemblies 20. The abrasive roll flange 21 also consists of internal threads 29 for mounting the abrasive roll element 40 using the bolts 50, and a central air opening 28 for air entry or circulation into the milling chamber 103 from top to bottom of the milling machine 100. The guiding members 25 are circumferentially spaced apart each other to form the openings 26 for entry and exit of the adjacent abrasive roll flanges or assemblies 20. The supporting plate 30 is placed in opposite to the projecting member 22 of the abrasive roll flange 21, such that the supporting plate 30 is fastened to the abrasive roll flange 21 using the bolts 50 to secure and hold the abrasive roll element.

Figure 4:
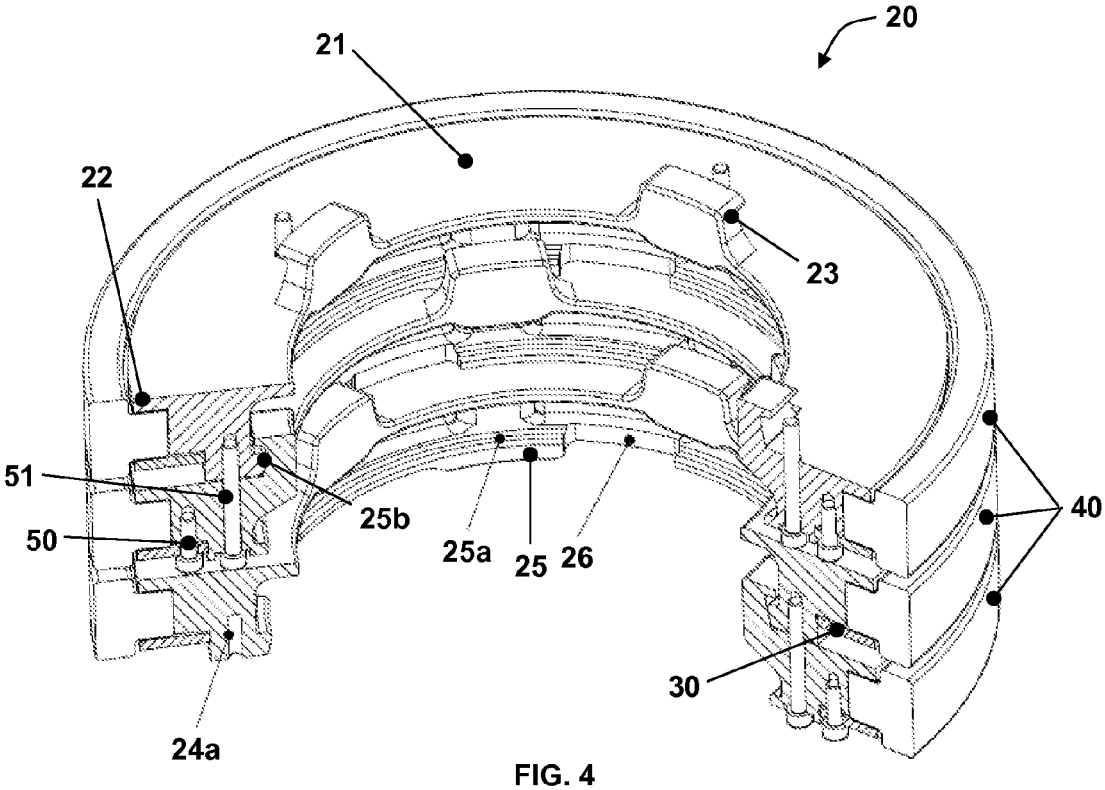
FIG. 4 illustrates an isometric sectional view of a set of abrasive roll assemblies, in accordance with an exemplary embodiment of the present invention.
Figure 5:
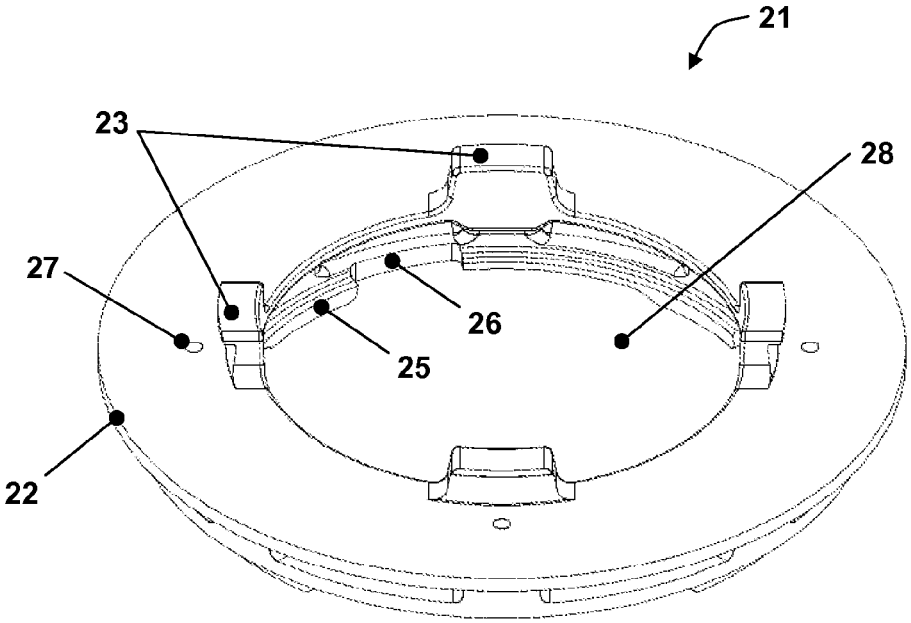
FIG. 5 illustrates an isometric view of an abrasive roll flange of the abrasive roll assembly, in accordance with an exemplary embodiment of the present invention.

Referring to FIG. 4, an isometric sectional view of a set of abrasive roll assemblies 20 (20*a* or 20*b*) is illustrated, in accordance with an exemplary embodiment of the present invention. The subsequent abrasive roll assemblies 20 (20*a* or 20*b*) are configured with similar arrangement to lock with the previous abrasive roll assemblies 20 (20*a* or 20*b*). The projecting member 22 is formed on the outer periphery of the abrasive roll assembly 20. The abrasive roll assembly 20 is mounted to the previous abrasive roll assembly 20 (20*a* or 20*b*) or conveyor assembly 10 by threading fasteners 51 like bolts, into the through holes 27 of abrasive roll assembly 20 and the internal threads 24*a* in the pads 24 of the previous abrasive roll assembly 20 (20*a* or 20*b*). The projecting lugs 23 are formed on the upper portion of the abrasive roll assembly 20 and is arranged with resting and guiding portions 23*a*, 23*b*, as shown in FIG. 5, which illustrates an isometric view of the abrasive roll flange 21 of the abrasive roll assembly 20, in accordance with an exemplary embodiment of the present invention. The guiding portion 23*b* is formed of a combination of circular surface and conical surface.

Figure 6:
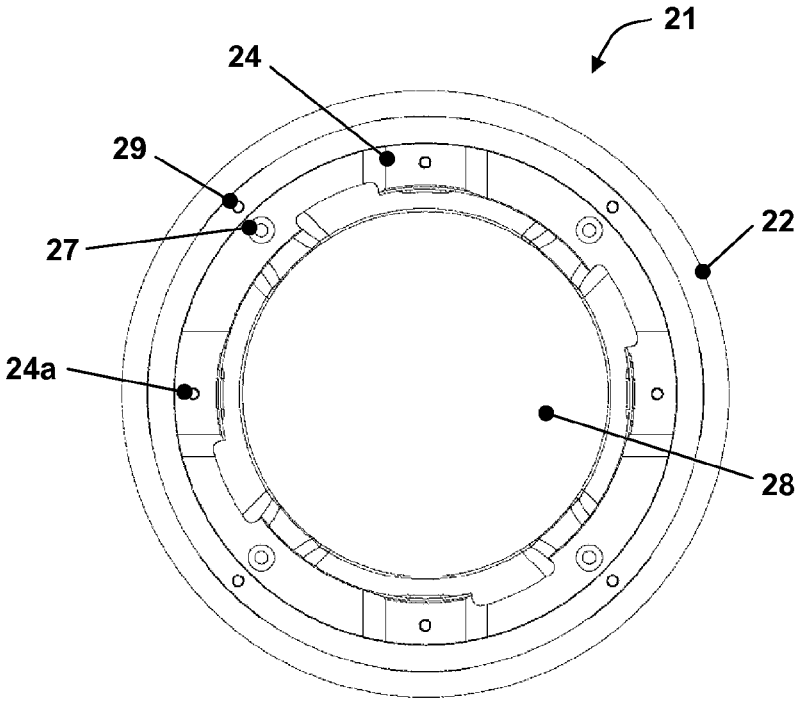
FIG. 6 illustrates a bottom view of the abrasive roll flange of the abrasive roll assembly, in accordance with an exemplary embodiment of the present invention.
Figure 7:
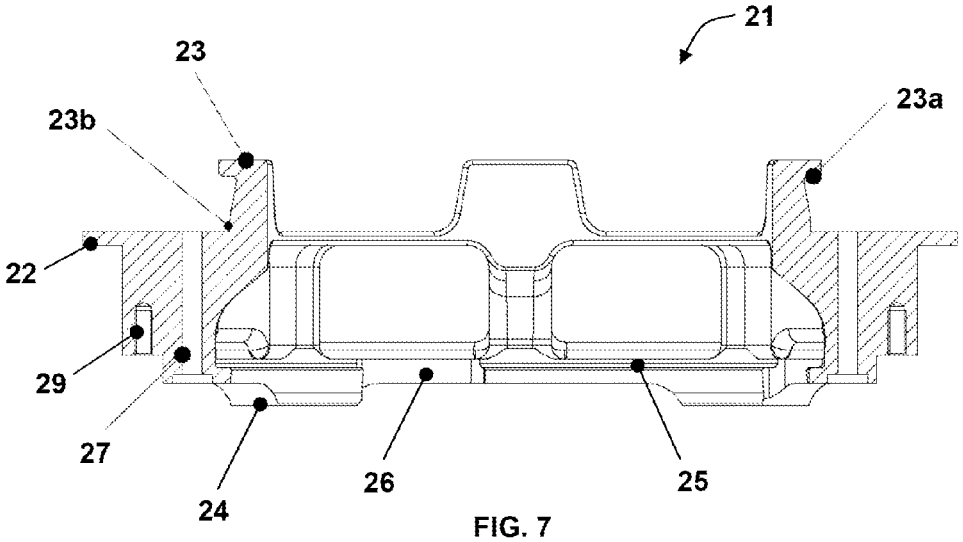
FIG. 7 illustrates a sectional view of the abrasive roll flange of the abrasive roll assembly, in accordance with an exemplary embodiment of the present invention.
Figure 8:
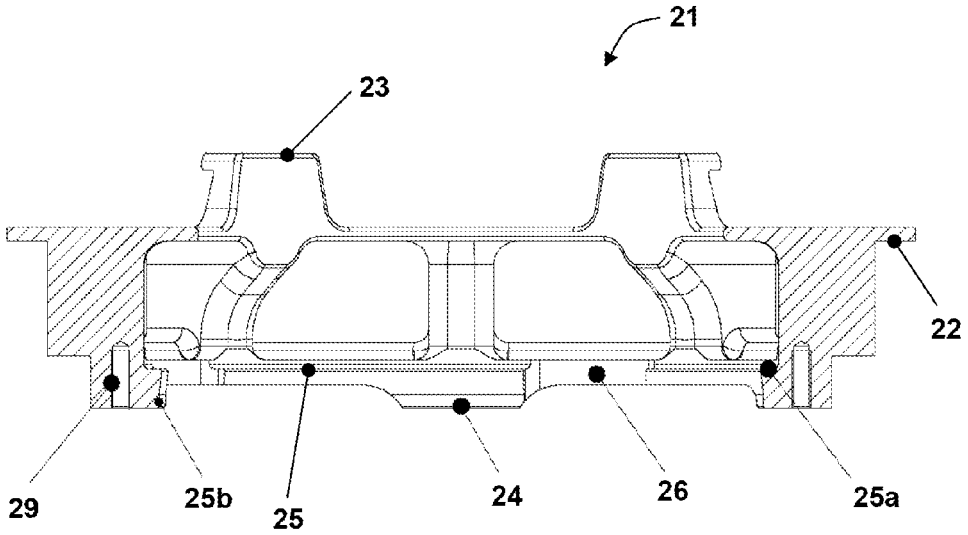
FIG. 8 illustrates a sectional view of the abrasive roll flange of the abrasive roll assembly, in accordance with an exemplary embodiment of the present invention.

Referring to FIG. 6-8, sectional and bottom views of the abrasive roll flange 21 of the abrasive roll assembly 20 are respectively illustrated, in accordance with an exemplary embodiment of the present invention. The projecting pads 24 are arranged with threaded holes 24*a* for mounting the subsequent abrasive roll flanges or assemblies 20 (20*a* or 20*b*).

After inserting the abrasive roll assembly 20 from bottom through openings 3 or 26 of the adjacent flange 11 or 21, the abrasive roll assembly 20 is rotated to make the resting portion 23*a* of each projecting lug 23 of the abrasive roll flange 21 resting on the surface 2*a* or 25*a* of each guiding member 2 or 25 of the adjacent flange 11 or 21, such that each through hole 27 of the abrasive roll flange 21 is aligned with threaded hole 4*a* or 24*a* in each projecting pad 4 or 24 of the adjacent flange 11 or 21 for mounting the abrasive roll assembly 20 to the adjacent flange 11 or 21, which ensures centre axial alignment of both the abrasive roll assembly 20 and the adjacent flange 11 or 21 with respect to the main shaft 101 of the milling machine 100.

While fixing the abrasive roll assembly 20 to the adjacent flange 11 or 21, the guiding portion 23*b* of each projecting lug 23 of the abrasive roll assembly 20 is axially guided and aligned on guiding surface 2*b* or 25*b* of each guiding member 2 or 25 of the adjacent flange 11 or 21, such that centre axial alignment in both the abrasive roll assembly 20 and the adjacent flange 11 or 21 is maintained with respect to the main shaft 101 of the milling machine 100. The adjacent flange represents either conveyor flange 11 or abrasive roll flange 21. The guiding surface 2*b* or 25*b* of each guiding member 2 or 25 of the adjacent flange 11 or 21 is designed as a combination of circular surface and conical surface. Such arrangement of abrasive roll assembly 20 facilitates easy removal and replacing of the worn-out roll assembly without dismantling all components of the milling machine 100 and without altering pulley and axial alignment.

The rotary movement of the main shaft 101 is transferred to the conveyor assembly 10 for driving and rotating one or more abrasive roll assemblies 20 attached to it, which evenly distributes rotary motion from top to bottom of the milling machine 100 and ensures co-linearity of axial centre of the conveyor assembly 10 and the one or more abrasive roll assemblies 20 in relation to the main shaft 101. The arrangement of conveyor assembly 10 and abrasive roll assemblies 20 in this milling machine 100 minimizes labor, time and cost consumption during maintenance and replacement of worn-out roll assembly.

Figure 9:
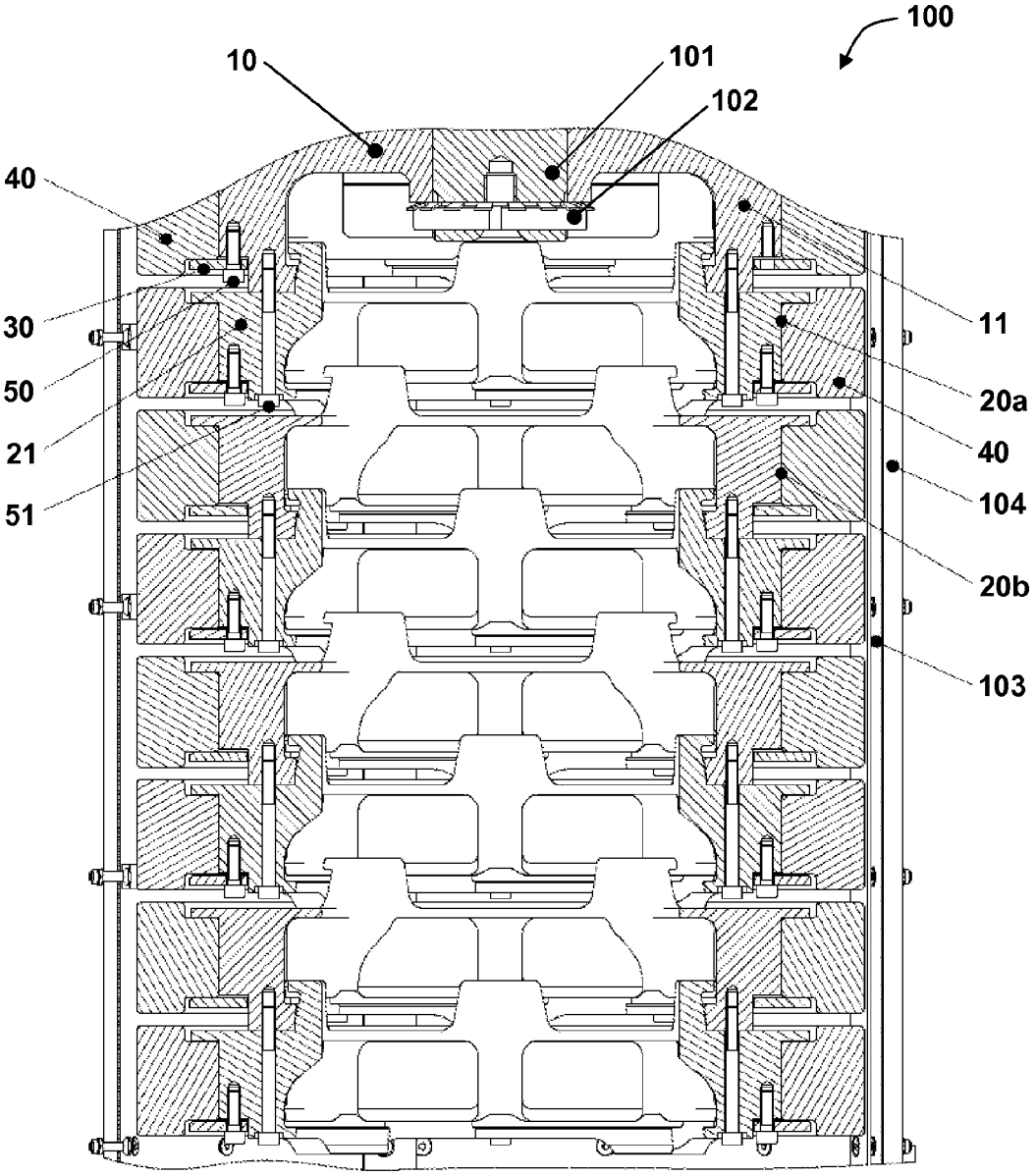
FIG. 9 illustrates a partial vertical sectional view of a vertical abrasive milling machine, in accordance with an exemplary embodiment of the present invention.

Referring to FIG. 9, a partial vertical sectional view of a vertical abrasive milling machine 100 is illustrated, in accordance with an exemplary embodiment of the present invention. The vertical abrasive milling machine 100 consists of a bearing housing that is vertically mounted on a main structure of the milling machine 100. A main shaft 101 is rotatably supported in the bearing housing by means of upper and lower bearings. A pulley is mounted on the upper portion of main shaft 101 and is connected to motor pulley by means of conveying V-belts. The main shaft 101 extends vertically up to a screw conveyor assembly 10 having a screw conveyor for feeding food grains. The milling machine 100 also comprises an inlet connecting member for the granular material or food grains to be treated, with the food grains discharged at the bottom side via a hopper after the treatment. The inlet connecting member is associated with an inlet chute through which the food grains to be treated is introduced into the milling chamber 103 via the screw conveyor. The milling chamber is enclosed by an outer body structure 104 of the milling machine 100. In the present milling chamber arrangement, first abrasive roll assembly 20*a* is mounted on the screw conveyor assembly 10 and the subsequent abrasive roll assemblies 20*b* are mounted on each other for polishing the food grains, which avoids extension of main shaft 101 throughout the milling chamber 103 for milling operation.

In the present milling machine, all the abrasive roll assemblies 20 (20*a*, 20*b*) are assembled from top to bottom fashion in comparison with the conventional milling machine having bottom to top assembling. The screw conveyor is fixed to the screw conveyor flange 11 that is coupled to the main shaft 101 by means of ring nut 102. A rotary ring is mounted on the main structure. The uppermost abrasive roll element 40 is mounted on the screw conveyor flange 11 by bolts 50 threaded into the screw conveyor flange 11 and the supporting plate 30. The intermediate abrasive roll assembly 20*a* is inserted from bottom in the circumferentially spaced openings 3 of the screw conveyor flange 11, such that the abrasive roll flange 20*a* enters the openings 3 of the screw conveyor flange 11. Then, the abrasive roll assembly 20*a* is rotated to place the abrasive roll flange 21 on the internal circular land 2 of the screw conveyor flange 11 without bolting the abrasive roll assembly 20*a*. While placing, the abrasive roll flange lug surface 23*a* sits on the internal circular land 2 of the screw conveyor flange 11. The intermediate abrasive roll assembly 20*a* is fixed to the screw conveyor flange 11 via bolt 51 by aligning axis of the abrasive roll flange clearance hole 27 and the threaded hole 4*a* on the screw conveyor flange 11. When the bolts 51 are rotated to fix, the bolts 51 push the intermediate abrasive roll assembly 20*a* upwards. The internal surface 2*b* on the screw conveyor flange 11 locates and guides the axis of abrasive roll assembly 20*a* in relation to the main shaft 101. The internal surface 2*b* of the conveyor flange 11 and the external surface 23*b* of the lug 23 consist of circular surface and conical surface. The circular external surface 23*b* on lugs 23 acts as guiding member to abrasive roll assembly 20*a* ensuring axis coaxial. The conical surface in the internal surface 2*b* and the external surface 23*b* helps to rotate the abrasive roll assembly 20 freely. The circular internal surface 2*b* acts as guiding member to the abrasive roll assembly 20*a* ensuring axis coaxial. Hence, the first intermediate abrasive roll assembly 20*a* is attached to the screw conveyor flange 11.

Next (second) intermediate abrasive roll assembly 20*b* is inserted from bottom in the openings 26 of the abrasive roll flange 21 of the first abrasive roll assembly 20*a*. The abrasive roll flange 21 of the second abrasive roll assembly 20*b* enters the openings 26 of the abrasive roll flange 21 of the first intermediate abrasive roll assembly 20*a*. Then, the second abrasive roll assembly 20*b* is rotated to place it on the internal circular land 25 of the abrasive roll flange 21 of the fist assembly 20*a* without bolting the second abrasive roll assembly 20*b*. While placing, the abrasive roll flange lug surface 23*a* of the second assembly 20*b* sits on the internal circular land 25 of the first intermediate abrasive roll assembly 20*a*. The second intermediate abrasive roll assembly 20*b* is fixed to the first intermediate roll assembly 20*a* via bolts 51 by aligning axis of the flange clearance hole 27 of the second abrasive roll assembly 20*b* and the flange threaded hole 24*a* of the first abrasive roll assembly 20*a*. When the bolts 51 are rotated to fix, the bolts 51 push the second intermediate abrasive roll assembly 20*b* upwards, the internal surface 25*b* of the guiding member 25 of the first abrasive roll assembly 20*a* locates and guides axis of the second abrasive roll assembly 20*b* in relation to the main shaft 101. The internal surface 25*b* on the guiding member 25 of the first assembly 20*a* acts as guiding member to the second abrasive roll assembly 20*b* ensuring axis coaxial. The internal surface 25*b* on the guiding member of the first assembly 20*a* and the external surface 23*b* of the lugs 23 of the second assembly 20*b* consist of circular surface and conical surface, which helps to rotate the abrasive roll assembly 20*a*, 20*b* freely. Hence, the first intermediate abrasive roll assembly 20*a* is attached to the second intermediate abrasive roll assembly 20*b*. Similarly, the subsequent intermediate abrasive roll assemblies 20 are fixed alternatively to each other in the above mentioned approach one after the other from top to bottom.

Such arrangement of milling machine 100 is simple in construction, Easy to remove the worn out last abrasive roll assembly quickly and effortlessly without dismantling the rotor shaft assembly and without altering pulley alignment. It also improves aspiration/air circulation inside the milling chamber and facilitates easy maintenance because of shaft less arrangement in the abrasive roll assemblies inside the milling chamber. It reduces maintenance time and manpower required for higher capacity machines, and also minimizes labor and cost consumption during maintenance and replacement of worn-out roll assembly.

The foregoing description is a specific embodiment of the present invention. It should be appreciated that this embodiment is described for purpose of illustration only. It is evident to those skilled in the art that although the invention herein is described in terms of specific embodiments thereof, there exist numerous alternatives, modifications and variations of the invention. It is intended that all such modifications and alterations be included insofar as they come within the spirit and scope of the invention as claimed or the equivalents thereof. Hence all variations, modifications and alternatives that falls within the broad scope of the appended claims comes under the gamut of the invention.

We claim:

1. An abrasive roll assembly, comprising:

an abrasive roll element;

an abrasive roll flange having a projecting member formed on its outer periphery and a plurality of through holes configured for mounting the abrasive roll flange to an adjacent flange, a plurality of projecting lugs formed on an upper portion of the abrasive roll flange, the lugs having a guiding and a resting portion, a plurality of projecting pads arranged with threaded holes for mounting the adjacent flange, and a plurality of guiding members circumferentially spaced apart each other to form a plurality of openings for entry and exit of the adjacent flange; and a supporting plate placed in opposite to the projecting member of the abrasive roll flange, such that the supporting plate is fastened to the abrasive roll flange using fasteners to secure and hold the abrasive roll element, wherein after inserting the abrasive roll assembly from bottom through openings of the adjacent flange, the abrasive roll assembly is rotated to make the resting portion of each projecting lug of the abrasive roll flange resting on the surface of each guiding member of the adjacent flange, such that each through hole of the abrasive roll flange is aligned with threaded hole in each projecting pad of the adjacent flange for mounting the abrasive roll assembly to the adjacent flange, which ensures center axial alignment of both the abrasive roll assembly and the adjacent flange with respect to a main shaft of a milling machine.

2. The abrasive roll assembly as claimed in claim 1, wherein while fixing the abrasive roll assembly to the adjacent flange, the guiding portion of each projecting lug of the abrasive roll assembly is axially guided and aligned on guiding surface of each guiding member of the adjacent flange, such that center axial alignment in both the abrasive roll assembly and the adjacent flange is maintained with respect to the main shaft of the milling machine.

3. The abrasive roll assembly as claimed in claim 2, wherein the adjacent flange represents either a conveyor flange or an abrasive roll flange.

4. The abrasive roll assembly as claimed in claim 1, wherein the adjacent flange represents either a conveyor flange or an abrasive roll flange.

5. The abrasive roll assembly as claimed in claim 1, wherein the abrasive roll flange is configured with a central air opening for free air circulation inside a milling chamber from top and bottom side of the milling machine.

6. The abrasive roll assembly as claimed in claim 1, wherein the through holes, the projecting lugs and the projecting pads are circumferentially spaced apart each other.

7. The abrasive roll assembly as claimed in claim 1, wherein the guiding portion of each projecting lug is formed of a combination of circular surface and conical surface.

8. The assembly as claimed in claim 1, wherein the guiding members are placed in proximity to the projecting pads.

9. The assembly as claimed in claim 1, wherein the guiding surface of each guiding member is formed of a combination of circular surface and conical surface.

10. A conveyor assembly, comprising:

an abrasive roll element;

a conveyor flange assembled with a screw conveyor and coupled to a main shaft of a milling machine by means of locking nut, the conveyor flange is composed of a projecting member formed on its outer periphery, a plurality of projecting pads arranged with threaded holes for mounting an adjacent abrasive roll flange, and a plurality of guiding members circumferentially spaced apart each other to form a plurality of openings for entry and exit of the adjacent abrasive roll flange; and a supporting plate placed in opposite to the projecting member of the conveyor flange, such that the supporting plate is fastened to the conveyor flange using fasteners to secure and hold the abrasive roll element, wherein after inserting the adjacent abrasive roll flange from bottom through the openings of the conveyor flange, the adjacent abrasive roll flange is rotated to make each projecting lug of the adjacent abrasive roll flange resting on the surface of each guiding member of the conveyor flange, such that the threaded hole in each projecting pad of the conveyor flange is aligned with each through hole of the adjacent abrasive roll flange for mounting the adjacent abrasive roll flange to the conveyor flange, which ensures center axial alignment of both the conveyor flange and the adjacent abrasive roll flange with respect to the main shaft of the milling machine.

11. The conveyor assembly as claimed in claim 10, wherein while fixing the adjacent abrasive roll flange to the conveyor assembly, a guiding portion of each projecting lug of the adjacent abrasive roll flange is axially guided and aligned on guiding surface of each guiding member the said conveyor assembly, such that center axial alignment in both the conveyor assembly and the adjacent abrasive roll flange is maintained with respect to the main shaft of the milling machine.

12. The conveyor assembly as claimed in claim 10, wherein the conveyor flange is configured with a plurality of air openings for free air circulation inside a milling chamber from top and bottom side of the milling machine.

13. The conveyor assembly as claimed in claim 10, wherein the projecting pads are circumferentially spaced apart each other.

14. The assembly as claimed in claim 10, wherein the guiding members are placed in proximity to the projecting pads.

15. The assembly as claimed in claim 10, wherein the guiding surface of each guiding member is formed of a combination of circular surface and conical surface.

16. A vertical abrasive type milling machine, comprising:

a bearing housing vertically mounted on a main structure of the milling machine;

a main shaft rotatably supported in the bearing housing by means of upper and lower bearings, the main shaft is mounted to a machine pulley that is connected to a motor pulley by means of conveying belts; and at lease one conveyor assembly, comprising an abrasive roll element; a conveyor flange assembled with a screw conveyor and coupled to the main shaft by means of locking nut, the conveyor flange is composed of a projecting member formed on its outer periphery, a plurality of projecting pads arranged with threaded holes for mounting an adjacent abrasive roll flange, and a plurality of guiding members circumferentially spaced apart each other to form a plurality of openings for entry and exit of the adjacent abrasive roll flange; and a supporting plate placed in opposite to the projecting member of the conveyor flange, such that the supporting plate is fastened to the conveyor flange using fasteners to secure and hold the abrasive roll element, wherein after inserting the adjacent abrasive roll flange from bottom through the openings of the conveyor flange, the adjacent abrasive roll flange is rotated to make each projecting lug of the adjacent abrasive roll flange resting on the surface of each guiding member of the conveyor flange, such that the threaded hole in each projecting pad of the conveyor flange is aligned with each through hole of the adjacent abrasive roll flange for mounting the adjacent abrasive roll flange to the conveyor flange, which ensures center axial alignment of both the conveyor flange and the adjacent abrasive roll flange with respect to the main shaft of the milling machine; and one or more abrasive roll assemblies, each comprising an abrasive roll element; an abrasive roll flange that is composed of a projecting member formed on its outer periphery, a plurality of through holes configured for mounting the abrasive roll flange to an adjacent flange, a plurality of projecting lugs formed on its upper portion, with guiding and resting portions, a plurality of projecting pads arranged with threaded holes for mounting the adjacent flange, and a plurality of guiding members circumferentially spaced apart each other to form a plurality of openings for entry and exit of the adjacent flange; and a supporting plate placed in opposite to the projecting member of the abrasive roll flange, such that the supporting plate is fastened to the abrasive roll flange using fasteners to secure and hold the abrasive roll element, wherein after inserting the abrasive roll assembly from bottom through openings of the adjacent flange, the abrasive roll assembly is rotated to make the resting portion of each projecting lug of the abrasive roll flange resting on the surface of each guiding member of the adjacent flange, such that each through hole of the abrasive roll flange is aligned with threaded hole in each projecting pad of the adjacent flange for mounting the abrasive roll assembly to the adjacent flange, which ensures center axial alignment of both the abrasive roll assembly and the adjacent flange with respect to the main shaft of the milling machine.

17. The milling machine as claimed in claim 16, wherein the rotary movement of the main shaft is transferred to the conveyor assembly for driving and rotating the one or more abrasive roll assemblies attached to it, which evenly distributes rotary motion from top to bottom of the milling machine and ensures co-linearity of axial center of the conveyor assembly and the one or more abrasive roll assemblies in relation to the main shaft.

18. An assembly, comprising:

an abrasive roll flange comprising a projecting member formed on its outer periphery and a plurality of through holes configured for mounting the abrasive roll flange to an adjacent flange, a plurality of projecting lugs formed on a portion of the abrasive roll flange, the lugs having a guiding and a resting portion, a plurality of projecting pads arranged with threaded holes for mounting the adjacent flange, and a plurality of guiding members circumferentially spaced apart each other to form a plurality of openings for entry and exit of the adjacent flange.

19. The assembly as claimed in claim 18, wherein the adjacent flange represents either a conveyor flange or an abrasive roll flange.

20. The assembly as claimed in claim 18, wherein the guiding members are placed in proximity to the projecting pads.

* * * * *